United States Patent [19]

Dubey

[11] 4,396,048

[45] * Aug. 2, 1983

[54] DEBARKING MACHINE

[75] Inventor: Dennis Dubey, Menominee, Mich.

[73] Assignee: Forest Country Engineering Company, Menominee, Mich.

[ * ] Notice: The portion of the term of this patent subsequent to Aug. 17, 1999, has been disclaimed.

[21] Appl. No.: 244,791

[22] Filed: Mar. 17, 1981

[51] Int. Cl.[3] ..... B27L 1/04

[52] U.S. Cl. ..... 144/208 F; 144/2 Z; 144/340

[58] Field of Search ..... 144/2 Z, 208 R, 208 F, 144/338, 340

[56] References Cited

U.S. PATENT DOCUMENTS 2,934,112 4/1960 Valo ..... 144/208 F
3,987,825 10/1976 Vignolles ..... 144/208 F
4,344,470 8/1982 Dubey ..... 144/2 Z

FOREIGN PATENT DOCUMENTS 1120857 4/1956 France ..... 144/208 F

*Primary Examiner*—W. D. Bray

[57] ABSTRACT

A machine is provided for removing the bark from logs. The machine supports a log for linear movement in the direction of the longitudinal axis of the log and for rotation about its longitudinal axis. A saw is supported for rotation about a second longitudinal axis generally parallel to the longitudinal axis of the log. The saw includes a saw blade wrapped around the second longitudinal axis in a helical pattern, the saw blade having a radially outer surface, a radially inner surface, and a cutting edge including saw teeth extending in the direction of the longitudinal axis of the log, the tips of the saw teeth projecting outwardly with respect to the saw blade. The saw is supported for selective engagement with the log, and is rotated about its longitudinal axis whereby the teeth will engage said log to strip the bark from the log.

20 Claims, 4 Drawing Figures

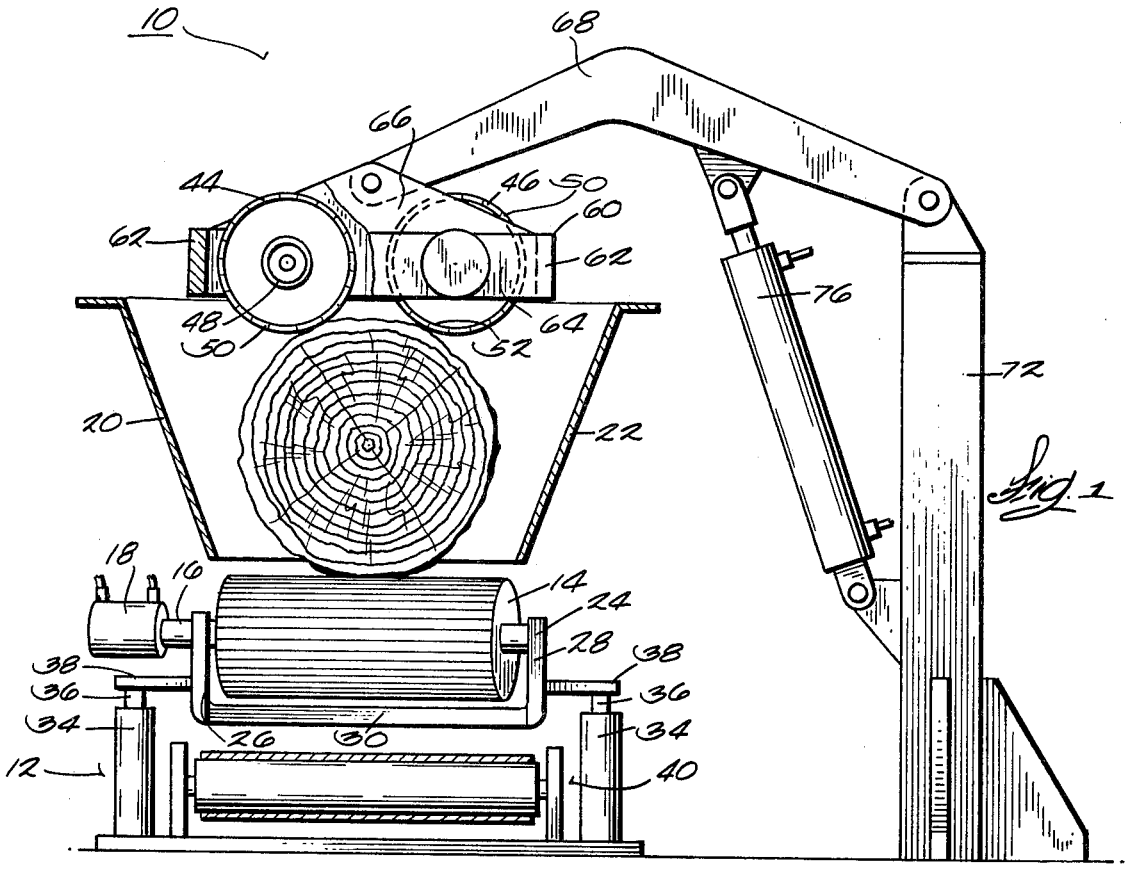
Fig. 1
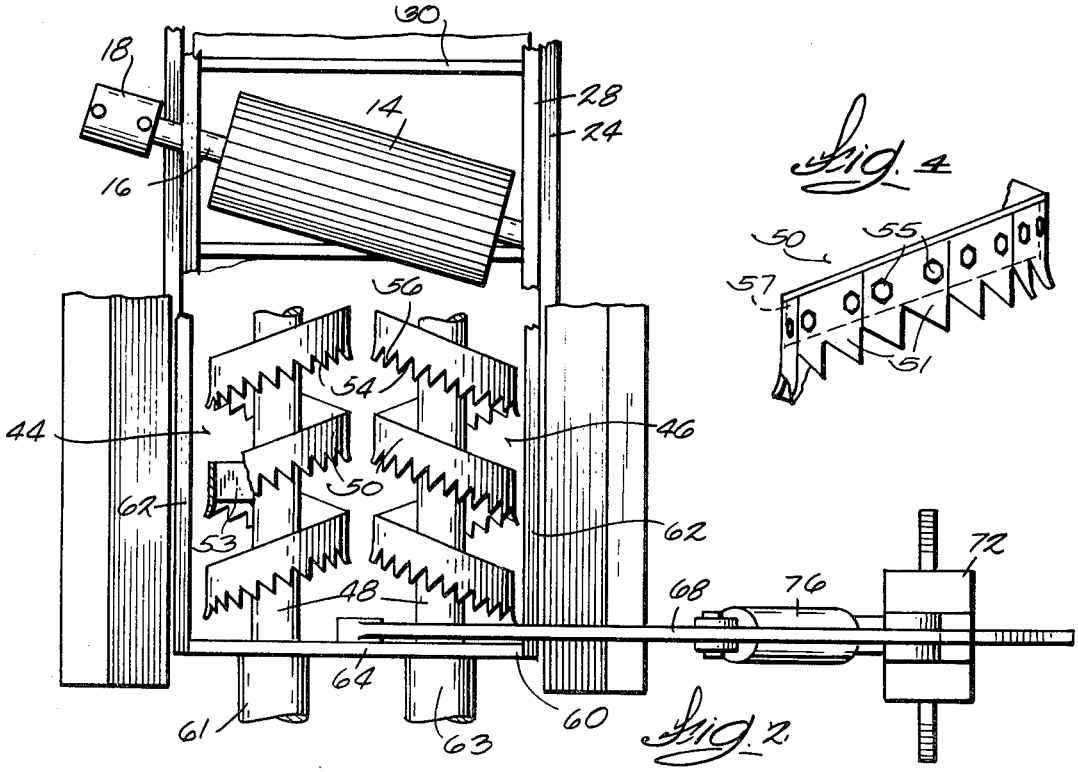
Fig. 2
Fig. 4

70
74
22
24
14
38
36
34
48
46
50
64
56
68
63
76
22
30
14
42
14
40

DEBARKING MACHINE

FIELD OF THE INVENTION

The invention relates to machines for use in removing bark from logs during the processing of the logs for use in a papermill, sawmill or the like.

BACKGROUND PRIOR ART

Machines for use in debarking applications commonly employ a number of individual cutting tools which are driven so as to engage the bark and strip or cut if from the tree. Examples of such machines are conventional ring debarkers which include means for feeding logs through a large ring, the ring supporting a number of knives or cutting tools which are supported by the ring for rotation around the logs, the knives, engage the bark to tear the bark from the log. One disadvantage of such machines and other prior art debarking machines is that the cutting tools provide a relatively small total cutting edge and the debarking operation is relatively slow.

Another problem in debarking logs is caused by the fact that the logs fed through the debarking machine may vary substantially in diameter and commonly the logs are not straight.

Another common problem in debarking applications is disposal of the waste material such as the bark which is stripped from the trees. During the debarking process, bark and other waste material builds up around the debarking machine. This material must be continuously removed if the machine is to remain operable.

Another of the problems with conventional debarking machines is that the cutting tools and drive mechanisms of such machines tend to be rapidly worn by the bark and by foreign matter on the logs.

While some of the prior art debarking machines have sought to overcome some of these deficiencies, those machines are relatively complicated and expensive. For example, ring debarkers which are provided with means for handling non-linear logs have relatively complicated apparatus for holding the opposite ends of the logs and for feeding the logs through the ring.

SUMMARY OF THE INVENTION

The present invention provides an improved debarking machine designed to overcome these problems of the prior art.

More particularly, the invention includes a machine for removing the bark from trees and includes means for supporting a log for linear movement in the direction of the longitudinal axis of the log and for causing rotation of the log about it longitudinal axis as it moves through the debarking machine. The machine also includes a saw supported for rotation about a longitudinal axis generally parallel to the longitudinal axis of the log. The saw includes a new blade wrapped around the axis of rotation of the saw in a helical pattern, the blade having a radially outer surface, a radially inner surface and a cutting edge. The cutting edge includes saw teeth which extend in the direction of the longitudinal axis and opposite the direction of the movement of the log. The ends of the cutting teeth are bent radially outwardly whereby the tips of the saw teeth will engage the bark of the log and strip or cut it from the tree. Means are also provided for rotating the saw about its longitudinal axis and for causing the saw blade to engage the log whereby the teeth will strip the bark from the tree.

One of the features of the invention is the provision of a plurality of rollers which are provided to support the log for linear movement and to cause rotation of the log as it moves linearly. These rollers are spaced along the length of the debarking machine and have parallel axes of rotation, these axes of rotation being generally horizontal but at an oblique angle with respect to the direction of movement of the log through the debarking machine.

Another feature of the invention is the provision of a pair of opposed elongated sidewalls on opposite sides of the rollers, the sidewalls sloping upwardly and outwardly. The log is positioned on the rollers and between the sidewalls, and the materials stripped from the log will be channeled downwardly by the sidewalls through openings between the rollers.

Another feature of the invention is the provision of a conveyor positioned beneath the rollers to receive materials stripped from the log and for conveying that material to further processing areas.

In one embodiment of the invention the debarking machine includes a pair of helical saws positioned in parallel side-by-side relationship and supported above the log such that they can be moved downwardly into engagement with the log for debarking.

Another feature of the invention is the provision of means for moving the rollers vertically with respect to the sidewalls whereby logs of various diameters can be supported by the rollers and housed between the sidewalls.

In one embodiment of the invention the helical blade can be comprised of a number of removable sections whereby sections of the saw blade can be easily removed and replaced by sharpened sections.

One of the advantages of the invention is the provision of a debarking apparatus having a structure which can accommodate logs of various sizes and logs which are not straight. Another advantage is the debarking machine provides a structure which can be positioned over a conveyor whereby the material can be immediately removed from the debarking area for further processing or disposal.

Another advantage of the invention is that it provides a simplified, less complicated structure which is less expensive to manufacture.

Another advantage is that the debarking machine provides more cutting surfaces or cutting edges in contact with the bark of the tree and decreases the time required for the debarking operation when compared with prior art debarking machines.

Various other features and advantages will be apparent by reference to the following description of the preferred embodiment, from the drawings and from the claims.

BRIEF DESCRIPTION OF THE DRAWINGS

FIG. 1 is an end elevation view of a debarking machine embodying the present invention.

FIG. 2 is a plan view of the debarking machine illustrated in FIG. 1.

FIG. 4 is an enlarged partial view of a second embodiment of a rotary saw, which can be employed in the debarking machine shown in FIG. 1, and with portions broken away.

Figure 3:
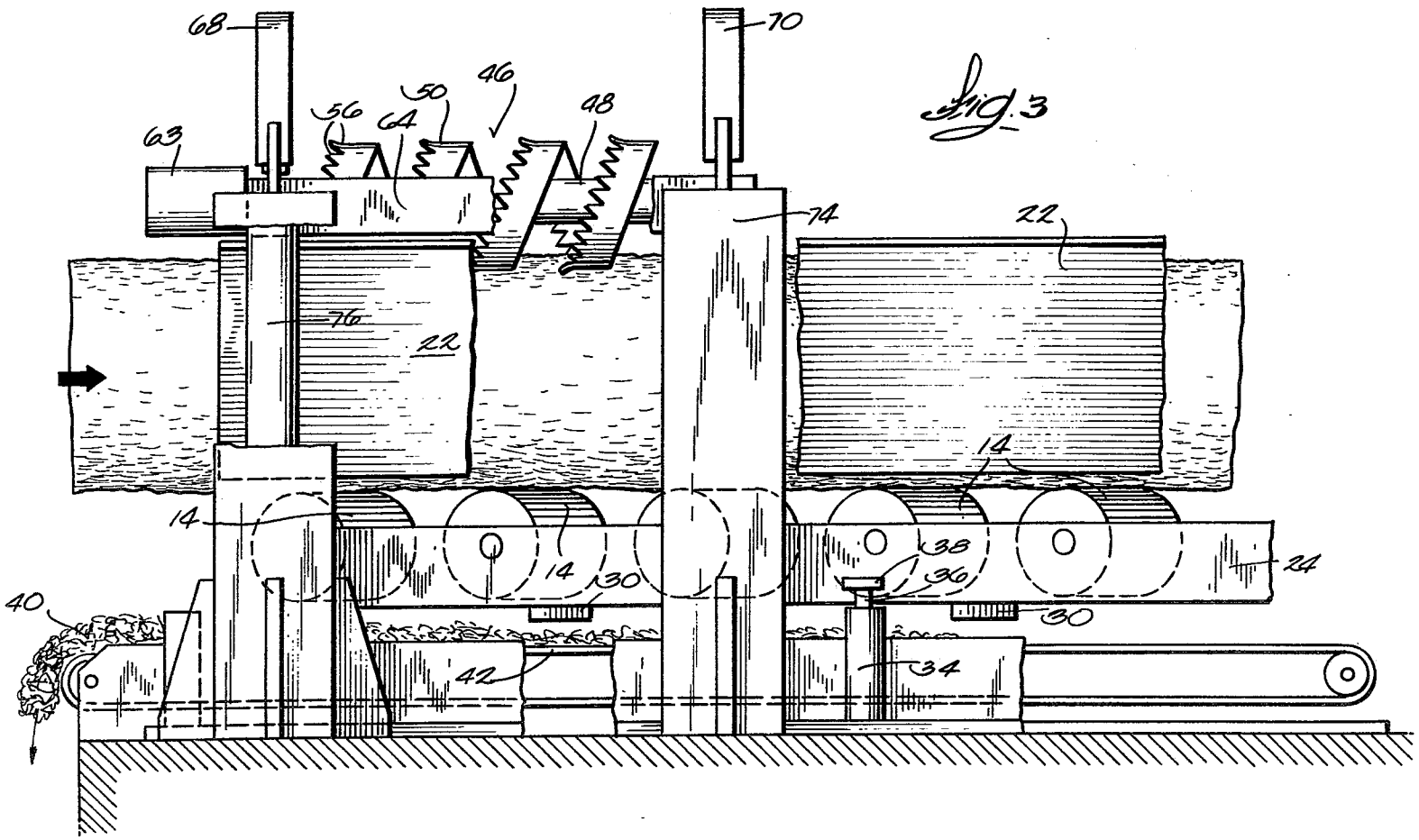
FIG. 3 is a side elevation view of the debarking machine illustrated in FIG. 1.

Before describing a preferred embodiment in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein is for the purpose of descripition and should not be regarded as limiting.

DESCRIPTION OF A PREFERRED EMBODIMENT

Illustrated in FIG. 1 is a debarking machine 10 embodying the present invention, the debarking machine including a frame 12 and means for supporting a log for linear movement in the direction of the longitudinal axis of the log and for supporting the log for rotation as it is moved linearly. While the means for supporting the log can have various configurations, in the illustrated construction the means for feeding and rolling the log includes a plurality of rollers 14 supported in spaced relation along the length of the frame. The rollers 14 are supported in generally horizontal and mutually parallel relation but with the axes of the rollers at an oblique angle with respect to the direction of movement of the logs.

Means are also provided for rotatably driving the rollers 14 in a direction such that the log resting on the rollers will be driven linearly. Since the rollers 14 are positioned at an oblique angle with respect to the direction of movement of a log through the debarking machine 10, rotation of the rollers 14 to cause the log to be driven linearly also causes rotation of the log about its longitudinal axis. While the means for driving the rollers can have various constructions, in the illustrated embodiment, the rollers are supported on supporting shafts 16 and a number of hydraulic motors 18 are provided for rotatably driving each of the supporting shafts 16 and the rollers 14, each roller 14 having a separate hydraulic drive. In other embodiments, other types of mechanical drives can be employed.

Means are further provided to support the log on the rollers 14 to control lateral movement of the log with respect to its direction of movement. This means includes a pair of elongated upwardly and outwardly diverging sidewalls 20 and 22. The opening formed by the lower edges of the sidewalls 20 and 22 is sufficiently wide that the rollers 14 can move upwardly between the sidewalls 20 and 22. The sidewalls 20 and 22 in the illustrated construction include elongated planar metal walls which slope upwardly and outwardly and which extend along the entire length of the debarking machine.

Means are further provided for supporting the rollers 14 for vertical movement upwardly through the opening formed by the lower edges of the sidewalls 20 and 22. When a straight log of relatively small diameter is positioned on the rollers 14, the log can be positioned between the lower edges of the sidewalls 20 and 22 since the width of the opening is sufficient to accomodate the log. However, if the log is bent, crooked or is of greater diameter than the width of the opening and if the rollers 14 are positioned below the opening, the log may become wedged between the sidewalls 20 and 22. Accordingly, the rollers 14 are supported to be movable upwardly between the sidewalls and to support the larger logs or bent logs such that they do not bind against the sloping sidewalls whereby the logs will be free to rotate as they move linearly over the rollers 14. The means for supporting the rollers for such vertical movement includes an elongated rectangular frame 24, each of the rollers 14 being supported by the frame for rotation about the longitudinal axis of the respective roller. More particulaly, the rectangular frame 24 comprises a pair of elongated parallel beams 26 and 28. The lower edges of the beams 26 and 28 are rigidly joined by cross members 30. The shafts 16 supporting rollers 14 are rotatably supported at their opposite ends by the elongated beams 26 and 28.

Means are also provided for causing vertical movement of the elongated rectangular frame 24 supporting the rollers 14. While this means for causing vertical movement can have various constructions, in the illustrated embodiment, hydraulic cylinders 34 are supported by the frame 12. The hydraulic cylinders 34 are positioned adjacent the elongated frame 24 and include pistons 36, the upper ends of the pistons 36 being rigidly joined by support arms 38 to the frame 24.

One of the features of the invention is that the trough formed by the elongated upwardly and outwardly sloping sidewalls 20 and 22 is open at the bottom such that the foreign material carried by the logs and the bark stripped from the logs can fall between the rollers 14 and onto a conveyor means 40 whereby this material can be immediately removed from the debarking area for disposal or for further processing. Examples of such further processing can include grinding in a mill whereby the bark can be employed as a fuel source. The conveyor means 40 is also functional to prevent the buildup of material around the debarker such that this waste material can not interfere with the continued operation of the debarker 10. While the conveyor mechanism can have various constructions, in the illustrated construction, the conveyor 40 is shown as comprising a conventional belt conveyor including an endless belt 42 and means for driving the belt. In other arrangements, the conveyor could comprise a sloped vibrating surface or some other conventional conveying means.

The debarking machine further includes a saw means which is provided for stripping the bark from the logs which are supported by the rollers 14. In the illustrated construction, the saw means includes a pair of saws 44 and 46 in parallel, side-by-side relation, the saws 44 and 46 being supported for rotation about their longitudinal axes, these longitudinal axes being parallel to the direction of movement of the logs and to the longitudinal axis of the logs being debarked. Each of the rotary saws 44 and 46 includes a central shaft 48 and a saw blade 50 which is spaced outwardly from the shaft and wrapped around the central shaft 48 in a helical pattern, the saw blade being supported in spaced relation from the central shaft. More particularly, the saw blade 50 has a configuration similar to a band saw which is wrapped around the central shaft 48 and supported with one of the side surfaces 52 of the band facing the central shaft 48 and with the cutting edge 54 of the blade facing the direction of the longitudinal axis of the saw. The imwardly facing surface 52 of the saw blade is welded to the radially outer edge of radially extending support plates 53 which are, in turn, welded to the central shaft 48. In other embodiments of the invention, the helical saw blade 50 can be welded to the radially outer edge of an auger flight which surrounds and is welded to the central shaft 48.

In other embodiments of the invention, as shown in FIG. 4, the cutting blade 50 of the helical saws can be comprised of a number of separate removable sections 51. The sections 51 can be secured by means of bolts 55 to a helical supporting band 57, the band 57 being fixedly joined to the central shaft 48. For example the helical band 57 can be welded to a number of radially extending support plates 53 in turn being welded to the central shaft 48. The removable blade sections 51 can be removed and replaced by sharpened sections 51 one-at-a-time in sequence. This facilitates sharpening of the saw blade without stopping operation of the machine for extended periods of time.

In the illustrated construction, the saws 44 and 46 are supported above the logs and can be lowered into engagement with the logs whereby teeth 56 of the cutting edge 54 of the saws will strip bark from the logs. More particularly, the saws 44 and 46 are supported such that they can move downwardly onto a log which is positioned on the rollers 14 and in such a manner that the saws are positioned on opposite sides of the center line of the log. The saws are supported by a rectangular frame 60 comprised of a pair of side channels joined by end members 64. The end members 64 in turn support the opposite ends of the saws 44 and 46 such that the saws are freely rotatable about their longitudinal axes. The end members 64 of the suspension frame 60 are supported by a pair of triangular trusses 66, the appexes of the triangular trusses 66 being pivotally joined to support arms 68 and 70. The support arms 68 and 70 are in turn pivotally joined at their lower ends to vertical support members 72 and 74, respectively. A pair of hydraulic cylinders 76 are provided to control vertical movement of the support arms 68 and 70. One of the hydraulic cylinders 76 is pivotally joined at its lower end to the vertical support member 72 and is pivotably connected at its upper end to the support arm 68 and at a point intermediate the opposite ends of the support arm 68. The other hydraulic cylinder (not shown) is similarly pivotably connected at its lower end to the vertical support 74 member and is pivotably joined to the support arm 70 at a position intermediate the opposite ends of that support arm.

Referring more particularly to the helical blades 50 of the saws 44 and 46, as shown in FIG. 2, the teeth 56 of the saws extend generally longitudinally with respect to the axis of the saws and in the direction opposite the direction of movement of the log on the rollers 14. The teeth 56 are also flared or curved outwardly with respect to the longitudinal axis of the respective saws such that as the saws rotate, the tips of the teeth 56 will engage the bark of the logs and cut or strip the bark from the logs. It should be understood that the amount of outward deflection of the saw teeth 76 can be selected as a function of the depth of cut desired. Additionally, the depth of cut can also be controlled by selection of the downward force of the saws 44 and 46 on the logs, this being accomplished by control of the hydraulic pressure applied to the hydraulic cylinders 76.

Means are also provided for causing rotation of the saws 44 and 46 about their longitudinal axes and in opposite rotational directions. While various means can be provided for causing rotation of the saws 44 and 46, in the illustrated arrangement a hydraulic motor 61 is supported by the frame 60 and is operably connected to the shaft 48 of saw 44 to cause rotation of the saw 44 in a clockwise direction as viewed in FIG. 1. Similarly a hydraulic motor 63 is supported by the frame 60 and is operably connected to the shaft 48 of the saw 46 for causing rotation of that saw in a counterclockwise direction as viewed in FIG. 1.

It should be noted that one of the advantages of the invention is that cutting teeth 56 along the entire length of both saws 44 and 46 will be engaging the logs to strip bark from the logs whereby the bark can be stripped from the logs at a high rate of speed. Accordingly, the logs can be fed by the rollers 14 at high speed through the debarking machine, yet all of the bark on the logs will be removed.

The bark and other material removed from the logs will be channeled downwardly by the elongated sloping sidewalls 20 and 22 and this material will fall between the rollers 14 and onto the conveyor 40 whereby it can be transferred for further processing or for use as fuel.

While in the illustrated embodiment the saws 44 and 46 are shown as having a length which is substantially less than the length of the elongated sidewalls 20 and 22, the length of the saws 44 and 46 is a function of a balance between providing a large number of cutting surfaces yet having the saws short enough that they can remove bark even from those logs which may have bends in them. If the saws are unduly long, the teeth of the saws will not engage identations in the logs, and accordingly, there will be portions of the log where the bark will not be removed. On the other hand, it is desirable to have as large a number of teeth engaging the log as possible to improve the speed at which the bark is removed from the logs whereby the logs can be fed by the rollers at a higher speed.

While the saws 44 and 46 have been described as being positioned above the log, in other embodiments the saws could be supported beneath the log and with the weight of the log forcing the log downwardly against the saws, or alternatively, the saws could be supported laterally of the log. Additionally, while the debarking machine is illustrated as having a pair of saws, in other embodiments one or more saws could be provided.

Various features of the invention are set forth in the following claims.

I claim:

1. A machine for removing the bark from logs, the machine comprising: means for supporting a log for linear movement in the direction of the longitudinal axis of the log and for rotation about said longitudinal axis, a saw supported for rotation about a second longitudinal axis generally parallel to the longitudinal axis of the log, said saw including a saw blade wrapped around said second longitudinal axis in a helical pattern, said saw blade having a radially outer surface, a radially inner surface, and a cutting edge, said cutting edge including saw teeth, said saw teeth extending in the direction of said longitudinal axis and the tips of said saw teeth projecting outwardly with respect to said saw blade, means for supporting said saw for selective engagement with the log whereby said saw teeth can engage the log, and means for causing rotation of said saw about said second longitudinal axis whereby said saw teeth will engage the log to strip the bark from the log.

2. The machine set forth in claim 1 and further including a pair of elongated sidewalls adapted to house the log therebetween, said elongated sidewalls being spaced apart at their lower edges and sloping upwardly and away from each other.

3. The machine set forth in claim 1 and further including a conveyor positioned beneath said means for supporting the log and for receiving material removed from the log by said saw.

4. A machine set forth in claim 3 and further including a pair of elongated sidewalls adapted to house the log therebetween, said sidewalls being spaced apart at their lower edges and sloping upwardly and outwardly away from each other, said sidewalls channeling material removed from said log onto said conveyor.

5. The machine set forth in claim 1 wherein the means for supporting the log includes at least one roller having a generally horizontal axis of rotation oriented obliquely with respect to said longitudinal axis of the log.

6. A machine as set forth in claim 5 wherein said means for supporting the log further includes means for rotatably driving said roller.

7. The machine as set forth in claim 6 wherein the means for supporting the log further includes means for supporting the roller for vertical movement.

8. The machine as set forth in claim 1 and further including a pair of elongated sidewalls positioned on opposite sides of said roller, said sidewalls being spaced apart at their lower edges to define an elongated opening therebetween and sloping upwardly and outwardly away from each other, and at least one roller having a generally horizontal axis of rotation oriented obliquely with respect to said longitudinal axis of the log, and means for causing vertical movement of said roller with respect to said sidewalls.

9. The machine as set forth in claim 8 and further including a conveyor positioned beneath said roller and for receiving material removed from said log by said saw.

10. The machine as set forth in claim 1 wherein the means for supporting the log includes a plurality of rollers, means for supporting said rollers in spaced apart relation in the direction of the longitudinal axis of the log, said rollers being supported for rotation about horizontal axes oriented obliquely with respect to the longitudinal axis of the log, and means for causing vertical movement of said rollers.

11. The machine as set forth in claim 1 wherein said saw teeth extend in a direction opposite to the direction of movement of the log.

12. The machine as set forth in claim 1 wherein the means for supporting said saw includes means for causing selective movement of said saw toward and away from the log.

13. A machine as set forth in claim 1 and further including a second saw supported for rotation about a longitudinal axis generally parallel to said longitudinal axis of said log and spaced from said longitudinal axis of said saw, and means for supporting said saws above said log and on opposite sides of the longitudinal axis of said log.

14. The machine as set forth in claim 13 wherein the blade of one of said saws is helically wrapped around its longitudinal axis in a first rotational direction and wherein said means for rotating causes rotation of said saw in said first direction, and wherein the blade of the other of said saws is helically wrapped around its longitudinal axis in an opposite rotational direction and further including means for causing rotation of said other of said saws in said opposite rotational direction.

15. The machine as set forth in claim 1 wherein said means for causing rotation of said saw causes rotation of said saw in the same rotational direction as the direction of helical wrap of said blade around the longitudinal axis of said saw.

16. A machine for removing the bark from logs, the machine comprising: means for supporting a log for linear movement in the direction of the longitudinal axis of the log and for rotating said log about said longitudinal axis, a cutting means for engaging the log and for stripping bark from the log, and means for supporting said cutting means for selective engagement with the log, said means for supporting the log including at least one roller for supporting a log thereon, said roller having a generally horizontal axis of rotational oriented obliquely with respect to said longitudinal axis of the log, and means for rotatably driving said roller, and a pair of elongated sidewalls adapted to house the log therebetween.

17. The machine set forth in claim 16 and further including a conveyor positioned beneath said means for supporting the log and for receiving material removed from the log by said saw, and wherein said sidewalls are spaced apart at their lower edges and slope upwardly and outwardly away from other, said sidewalls channeling material removed from said log onto said conveyor.

18. The machine as set forth in claim 16 wherein the means for supporting the log further includes means for supporting the roller for vertical movement.

19. The machine as set forth in claim 16 wherein the means for supporting the log includes a plurality of rollers, means for supporting said rollers in spaced apart relation in the direction of the longitudinal axis of the log, said rollers each being supported for rotation about horizontal axes oriented obliquely with respect to the longitudinal axis of the log, and means for causing vertical movement of said rollers.

20. A machine for removing the bark from logs, the machine comprising: means for supporting a log for linear movement in the direction of the longitudinal axis of the log and for rotation about said longitudinal axis, a saw supported for rotation about a second longitudinal axis generally parallel to the longitudinal axis of the log, said saw including a saw blade wrapped around said second longitudinal axis in the helical pattern, said saw blade having a radially outer surface, a radially inner surface, and a cutting edge, said cutting edge including saw teeth, said saw teeth extending in the direction of said longitudinal axis and the tips of said saw teeth projecting outwardly with respect to said saw blade, and said saw blade including of a plurality of separable sections, each of said sections including at least one of said saw teeth, and means for releaseably securing said separable sections together, means for supporting said saw for selective engagement with the log whereby said saw teeth can engage the log, and means for causing rotation of said saw about said second longitudinal axis whereby said saw teeth will engage the log to strip the bark from the log.

* * * * *